United States Patent [19]

Tosa et al.

[11] Patent Number: 4,890,438

[45] Date of Patent: Jan. 2, 1990

[54] INSULATED GLASS CONSTRUCTION AND METHOD OF MAKING SAME

[75] Inventors: Thomas F. Tosa, Grand Haven; Lawrence Mulder, Holland, both of Mich.

[73] Assignee: ODL, Incorporated, Zeeland, Mich.

[21] Appl. No.: 251,331

[22] Filed: Sep. 30, 1988

[51] Int. Cl.[4] ..... E04C 2/54

[52] U.S. Cl. ..... 52/790; 52/172; 52/788

[58] Field of Search ..... 52/788, 785, 790, 726, 52/171, 172

[56] References Cited

U.S. PATENT DOCUMENTS

| | | | |
|---|---|---|---|
| 4,149,348 | 4/1979 | Pyzewski | 52/788 X |
| 4,158,278 | 6/1979 | Cardinale et al. | 52/790 |
| 4,193,236 | 3/1980 | Mazzoni et al. | 52/398 X |
| 4,368,226 | 1/1983 | Mucaria | 52/768 X |
| 4,530,195 | 7/1985 | Leopold . | |
| 4,546,723 | 10/1985 | Leopold et al. . | |
| 4,628,582 | 12/1986 | Leopold . | |
| 4,741,127 | 5/1988 | Bockwinkel | 52/790 X |
| 4,741,127 | 5/1988 | Bockwinkel | 52/790 X |

OTHER PUBLICATIONS

Plastics Engineering Handbook, p. 767.

*Primary Examiner*—David A. Scherbel
*Assistant Examiner*—Creighton Smith
*Attorney, Agent, or Firm*—Warner, Norcross & Judd

[57] ABSTRACT

The specification discloses an improved insulated glass construction preventing relative slippage beween the hermetically sealed glass sheets. The construction conventionally includes a pair of glass sheets and a spacer frame positioned therebetween and sealed thereto. The spacer frame is recessed from the glass edges. An adhesive fills the recess preferably at discrete locations to bond the glass sheets together.

7 Claims, 1 Drawing Sheet

INSULATED GLASS CONSTRUCTION AND METHOD OF MAKING SAME

BACKGROUND OF THE INVENTION

The present invention relates to insulated glass constructions, and more particularly to such constructions wherein a pair of glass sheets are spaced from one another by a spacer frame extending about the periphery of the assembly.

Many insulated glass constructions have been developed to provide thermally efficient window assemblies. The most popular form includes at least two glass sheets and a spacer frame between each pair of sheets to space the sheets from one another. The air between the two sheets reduces thermal flow through the assembly and must be hermetically sealed to prevent moisture penetration which can condense on the interior glass surfaces.

Basically, two processes have been developed for hermetically sealing the glass sheets together and/or to the spacer frame. In a first construction, the glass sheets directly contact the spacer frame, which is recessed from the edges of the glass sheets. An adhesive, such as polysulfide, is applied in the edge recesses adjacent the spacer frames to be flush with the glass edges. However, the polysulfide adhesives do not provide a consistently reliable hermetic seal. Consequently, moisture penetration can occur with the above-noted problems.

In a second construction, butyl or other sealant is extruded onto both faces of the spacer frame before assembly of the glass sheets thereon. The sandwiched assembly is then processed through rollers to produce a unit having the required overall thickness. The butyl sealant does not adhere as strongly as the previously described polysulfide adhesives to the glass sheets. Accordingly, relative slippage between the sheets can result and thereby create seal damage with premature failure of the unit. Slippage problems are exacerbated when the units must be transported and/or handled substantially prior to installation within a final frame or product. This is particularly true with door lights which are typically assembled at a first location, transported from the first location to a second location, partially disassembled, and then installed within a door. Further, the insulated glass is typically supported at its edges by screw bosses within the door light further creating pressure points and possible relative slippage between the glass.

SUMMARY OF THE INVENTION

The aforementioned problems are overcome in the present invention wherein an insulated glass construction is provided to prevent relative slippage between the glass sheets and to protect the integrity of the hermetic seal. More specifically, the construction includes a pair of spaced transparent impermeable sheet, such as glass, and a spacer frame therebetween. A butyl sealant is used in conventional fashion to seal the glass sheets to the spacer frame. Further, the spacer frame is recessed from the aligned edges of the glass sheets to define a channel therewith. An adhesive is applied within the channel and extends therefrom to bond the two glass sheets together and prevent relative slippage.

The described construction protects the integrity of the hermetic seal by preventing relative slippage between the glass. Therefore, insulated glass units manufactured according to the present invention are more reliable, have a longer useful life, are more tolerant of transportation and manufacturing-all resulting in a longer service life.

These and other objects, advantages, and features of the invention will be more readily understood and appreciated by reference to the detailed description of the preferred embodiment and the drawings.

DETAILED DESCRIPTION OF THE PREFERRED EMBODIMENT

Figure 1:
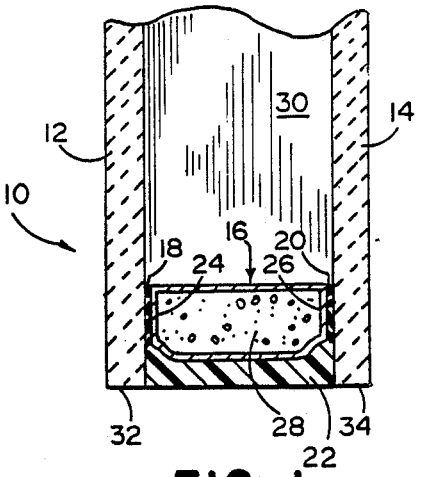
FIG. 1 is a fragmentary sectional view through the insulated glass.

An insulated glass assembly constructed in accordance with a preferred aspect of the invention is illustrated in FIG. 1 and generally designated 10. Generally speaking, the assembly includes a pair of transparent impermeable sheets 12 and 14, a spacer frame 16, butyl sealant 18 and 20, and a hot-melt adhesive 22. The sheets 12 and 14 are maintained in spaced relation by the frame 16 and are sealed thereagainst by the sealant 18 and 20. The adhesive 22 is applied within the channel defined by the sheets 12 and 14 and the frame 16 to adhesively bond the sheets to one another.

Transparent sheets 12 and 14 (FIGS. 1 and 2) are generally well known to those having ordinary skill in the art. In a presently preferred embodiment, the sheets are each one-eighth inch clear tempered glass. Other sheets may be substituted depending upon a particular application.

The spacer frame or spacer means 16 is also generally well known to those having ordinary skill in the art. One such frame is illustrated in U.S. Pat. No. 4,530,195 issued July 23, 1985 to Leopoid entitled SPACER FRAME FOR AN INSULATING GLASS PANEL AND METHOD OF MAKING THE SAME, the disclosure of which is hereby incorporated by reference. The spacer frame includes a pair of opposite edges 24 and 26 which face the sheets 12 and 14, respectively. Preferably, the spacer frame 16 includes a desiccant 28 within its interior to absorb moisture and/or humidity within the air trapped between the sheets 12 and 14 during manufacture. The distance between the edges 24 and 26 will vary depending upon a particular application to produce a panel of desired thickness having a desired insulative value. In a presently preferred embodiment, the distances between these opposite edges is five-eighths inch so that the thickness of the entire combination is seven-eighths inch.

The sealant 18 and 20 (FIG. 2) is also generally well known to those having ordinary skill in the art. In a presently preferred embodiment, the sealant is known as a butyl sealant and is applied about the entire periphery of the spacer frame 16 to hermetically seal one of the sheets 12 and 14 to the spacer frame. Although not specifically shown, the butyl is also applied into the channel 36 at any "breaks" in the spacer frame to insure continuity of the hermetic seal. Consequently, the insulative or dead space 30 between the sheets 12 and 14 is hermetically sealed. Manufacture of the assembly as thus far described (see FIG. 2) is generally well known to those having ordinary skill in the art and is described in further detail in the referenced U.S. Pat. No. 4,530,195.

Each of the sheets 12 and 14 is preferably substantially identical to the other in shape so that their peripheral edges 32 and 34, respectively, are aligned with one another about the periphery of the window. Presently, rectangular shapes are evisioned. Other possible shapes are limited only by present or future manufacturing technology. The spacer frame 16 is recessed from the aligned edges 32 and 34 to define a channel 36 bounded on three sides by the sheets 12 and 14 and the spacer frame.

The adhesive 22 (FIG. 1) fills the channel 36. The adhesive 22 adhesively bonds or intersecures the two glass sheets 12 and 14 to prevent relative slippage therebetween. The bond provided by the adhesive 22 is relatively stronger than the bond provided by the butyl sealant, particularly at elevated temperatures such as those experienced by door lights. Presently, hot-melt adhesives, such as polyesters and polyamides are preferred. Other suitable adhesives will be readily apparent to those having skill in the adhesive art.

It has been found that utilizing relatively short segments of adhesives along any two nonlinearly aligned edge portions of the assembly is adequate to prevent relative slippage between the sheets. Suitable portions include (1) opposite parallel edges or (2) perpendicular edges meeting in a corner. It has been found that four to five lineal inches of adhesive on each edge having adhesive is adequate to properly interbond the glasses for any size assembly 10 at least up to the size of a patio door. The adhesive is therefore preferably discontinuous about the perimeter of the assembly 10.

Manufacture and Use

Figure 2:
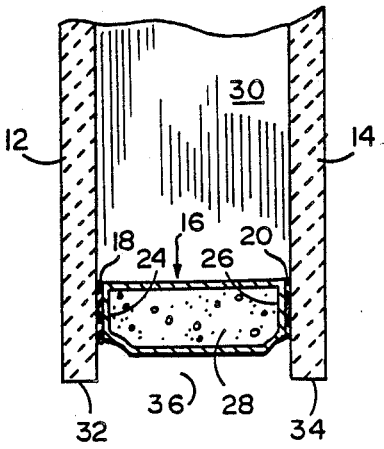
FIG. 2 is a fragmentary sectional view of the insulated glass prior to the application of the adhesive.

Manufacture of the assembly to the state illustrated in FIG. 2 is generally well known to those having ordinary skill in the art and is described in the referenced U.S. Pat. No. 4,530,195. Following manufacture of the assembly as thus described, the adhesive 22 is added to create the present invention as illustrated in FIG. 1. Presently, the adhesive is either "gunned on" or applied by hand using a trowel. The adhesive fills the entire channel 36 (see FIG. 2) at each segment of adhesive.

The above description is that of a preferred embodiment of the invention. Various alterations and changes can be made without departing from the spirit and broader aspects of the invention as set forth in the appended claims, which are to be interpreted in accordance with the principles of patent law including the doctrine of equivalents.

We claim:

1. An insulated glass panel comprising:

a pair of rectangular transparent sheets each having an edge;

a spacer means for spacing said sheets a substantially uniform distance from one another, said spacer means being recessed from said edges to form a recess between said spacer means and said edges;

a sealant between said spacer means and each of said sheets to hermetically seal said spacer means to said sheets; and an adhesive means between said sheets for adhesively bonding said sheets to one another, said adhesive means located within said recess and contacting said transparent sheets and said spacer means, said adhesive means arranged in discontinuous segments along said spacer means, the bond provided by said adhesive means being relatively stronger than the bond provided by said sealant, whereby said adhesive means provides enhanced structural integrity.

2. An insulated window assembly as defined in claim 1 wherein said adhesive means comprises a hot-melt adhesive.

3. An insulated window assembly as defined in claim 1 wherein said sealant is a butyl sealant, and said adhesive means is a polyester or polyamide adhesive.

4. An insulated transparent assembly comprising:

a pair of transparent panels each having a peripheral edge;

spacer means between said panels for spacing said panels from one another, said spacer means being offset from a portion of said panel edges to define a recess;

sealant means between said spacer means and each of said panels for hermetically sealing said panels to said spacer means; and adhesive means within said recess between said panels for adhesively intersecuring said panels to one another, said adhesive engaging said spacer means and both of said panels, said adhesive means arranged in discontinuous segments along said peripheral edges, said adhesive means providing a relatively stronger bond than said sealant means so that said adhesive means enhances the structural integrity of said assembly.

5. An insulated glass assembly as defined in claim 4 wherein said panel edge portion includes only two nonlinearly aligned edge segments.

6. An insulated glass assembly as defined in claim 4 wherein said adhesive means comprises a hot-melt adhesive.

7. An insulated transparent assembly as defined in claim 4 wherein said sealant means is a butyl sealant, and said adhesive means is a polyester or polyamide adhesive.

* * * * *